US006310307B1

(12) United States Patent
Ciarcia et al.

(10) Patent No.: US 6,310,307 B1
(45) Date of Patent: Oct. 30, 2001

(54) CIRCUIT BREAKER ROTARY CONTACT ARM ARRANGEMENT

(75) Inventors: Ronald Ciarcia, Bristol; Lei Zhang Schlitz, Burlington, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/465,895

(22) Filed: Dec. 17, 1999

(51) Int. Cl.[7] ..... H01H 3/00; H01H 9/20

(52) U.S. Cl. ..... 200/244; 200/17 R; 200/400; 218/32; 335/16

(58) Field of Search ..... 200/6 R, 11 R, 200/1 R, 17 R, 400, 401, 501, 244, 248, 287, 323–325, 336, 337, 50.01, 50.32, 50.33–50.35; 218/22, 30–33, 146; 335/16

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |

(List continued on next page.)

FOREIGN PATENT DOCUMENTS

| | | |
|---|---|---|
| 819 008 A | 12/1974 | (BE) . |
| 897 691 A | 1/1984 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |

(List continued on next page.)

*Primary Examiner*—Michael Friedhofer
(74) *Attorney, Agent, or Firm*—Cantor Colburn LLP; Carl B. Horton

(57) ABSTRACT

A rotary contact arrangement for circuit breakers of the type including a pair of movable contacts (30,36), one arranged on each end of the rotary contact arm (32), utilizes a single pair of contact springs (38), one spring on each side of the rotary contact arm (32). The springs (38) are aligned to intersect the axis of rotation of the rotary contact arm (32) for automatic uniform contact force adjustment throughout the operating life of the circuit breaker.

14 Claims, 4 Drawing Sheets

U.S. PATENT DOCUMENTS

| | | | |
|---|---|---|---|
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |

| | | | | |
|---|---|---|---|---|
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |
| 5,784,233 | | 7/1998 | Bastard et al. | 361/36 |
| 6,084,489 | * | 7/2000 | Castonguay et al. | 335/167 |
| 6,114,641 | * | 9/2000 | Castonguay et al. | 200/244 |
| 6,204,743 | * | 3/2001 | Greenberg et al. | 335/172 |

FOREIGN PATENT DOCUMENTS

| | | |
|---|---|---|
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 223 155 | 1/1991 | (GB) . |
| 1 227 978 | 4/1986 | (RU) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER ROTARY CONTACT ARM ARRANGEMENT

BACKGROUND OF THE INVENTION

This invention relates to circuit breakers, and, more particularly, to a circuit breaker rotary contact arm arrangement.

U.S. Pat. No. 4,616,198 entitled CONTACT ARRANGEMENT FOR A CURRENT LIMITING CIRCUIT BREAKER describes the early use of a first and second pair of circuit breaker contacts arranged in series to substantially reduce the amount of current let-through upon the occurrence of an overcurrent condition.

When the contact pairs are arranged upon one movable rotary contact arm such as described within U.S. Pat. No. 4,910,485 entitled MULTIPLE CIRCUIT BREAKER WITH DOUBLE BREAK ROTARY CONTACT, some means must be provided to insure that the opposing contact pairs exhibit the same contact pressure to reduce contact wear and erosion.

One arrangement for providing uniform contact wear is described in U.S. Pat. No. 5,310,971 entitled ROTARY CONTACT SYSTEM FOR CIRCUIT BREAKERS. This arrangement includes a rotary contact arm that employs rollers between the movable contact arm and spring pins to reduce contact arm friction. A rotor assembly with four contact springs, two on each side of the rotor, offset from the center of the rotor to impart contact force between the fixed and movable contacts is also disclosed. However, the roller system used in this arrangement can cause friction between the rollers and contact arm, which will result in uneven contact forces and, therefore, uneven contact wear. In addition, a rotor with springs offset from the rotor's axis of rotation can cause a non-uniform force distribution between the fixed and movable contact pairs if one pair of contacts erodes more than the other pair. The erosion of the contact pair with lower force results in a further reduction in force that continues to accelerate the erosion process.

BRIEF SUMMARY OF THE INVENTION

In an exemplary embodiment of the invention, a circuit breaker rotary contact arrangement includes a rotor having first and second opposing sides with pin retainer slots formed on the first side and a movable contact arm disposed intermediate the first and second sides. The movable contact arm has movable contacts at opposite ends of the contact arm, with each movable contact arranged opposite a fixed contact. A pivot pin is arranged on a central portion of the movable contact arm, with the pivot pin extending within an aperture formed on a central portion of the rotor. The pivot pin allows rotation of the movable contact arm with respect to the rotor. First and second links are pivotally secured to a first side of the movable contact arm. A first spring pin extends from the first link through the first pin retainer slot, and a second spring pin extends from the second link through the second pin retainer slot. A spring is arranged proximate the first side of the rotor and extends from the first spring pin to the second spring pin. The spring exerts a spring force directed to intersect the axis of rotation of the pivot pin. The spring force urges the movable contacts towards the fixed contacts.

DETAILED DESCRIPTION OF THE INVENTION

Figure 1:
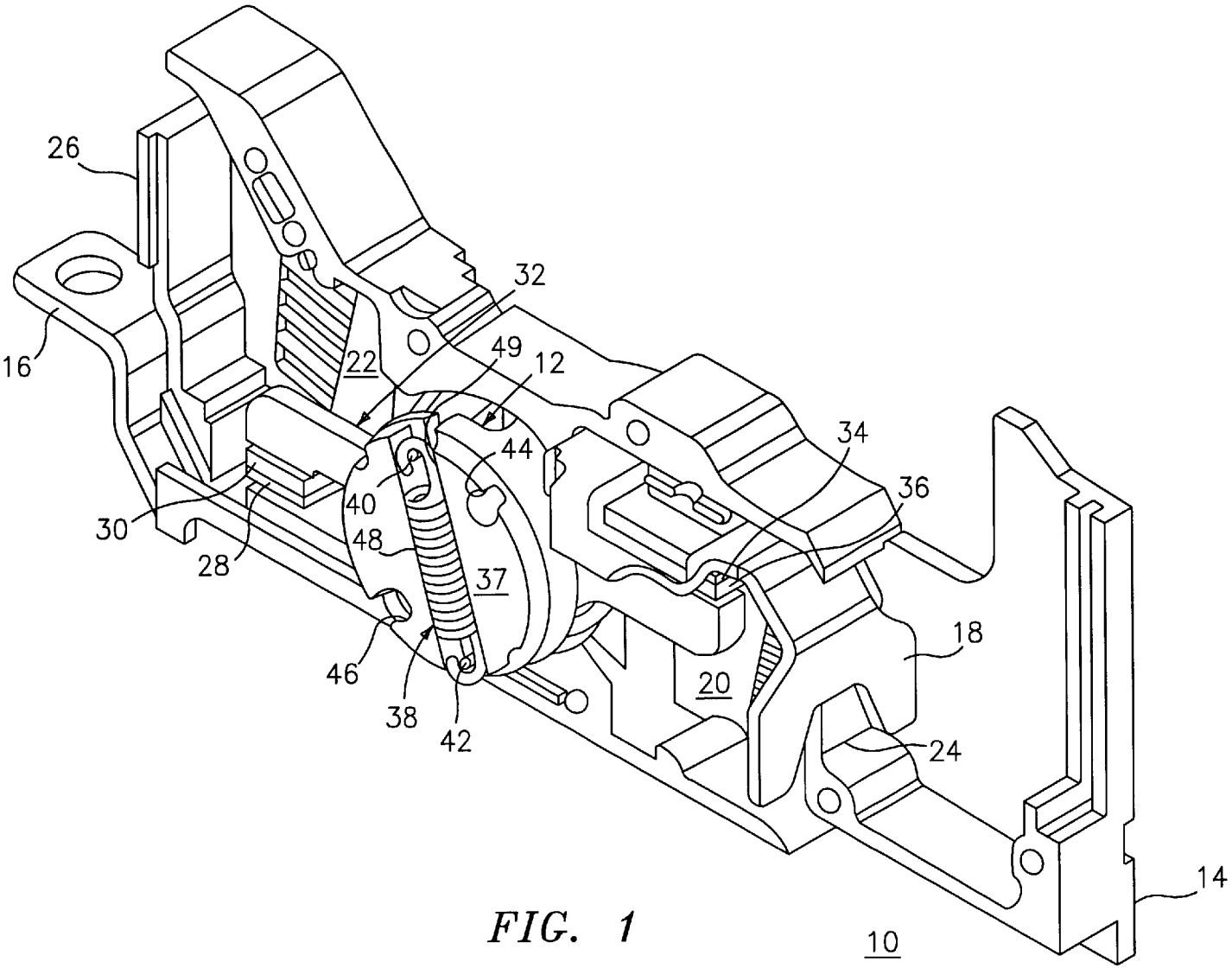
FIG. 1 is a front perspective view of a circuit breaker rotary cassette assembly employing the rotary contact assembly of the present invention.

Referring to FIG. 1, a rotary contact assembly 12 in a circuit breaker cassette assembly 10 is shown in an electrically-insulative cassette half piece 14 intermediate a line-side contact strap 16, load-side contact strap 18 and associated arc chutes 20, 22. In the embodiment shown, line-side contact strap 16 would be electrically connected to line-side wiring (not shown) in an electrical distribution circuit, and loadside contact strap 18 would be electrically connected to load-side wiring (not shown) via a lug (not shown) or some device such as a bimetallic element or current sensor (not shown). Electrically-insulative shields 24, 26 separate load-side contact strap 18 and line-side contact strap 16 from the associated arc chutes 20, 22 respectively. Although a single rotary contact assembly 12 is shown, it is understood that a separate rotary contact assembly is employed within each pole of a multi-pole circuit breaker and operate in a similar manner. The arc chutes 20, 22 are similar to that described within U.S. Pat. No. 4,375,021 entitled RAPID ELECTRIC ARC EXTINGUISHING ASSEMBLY IN CIRCUIT BREAKING DEVICES SUCH AS ELECTRIC CIRCUIT BREAKERS. Electrical transport through the circuit breaker interior proceeds from the line-side contact strap 16 to associated fixed and moveable contacts, 28, 30 at one end of a movable contact arm 32, to the fixed contacts and movable contacts 34, 36 at the opposite end thereof, to the associated load-side contact strap 18. The movable contact arm 32 is arranged between two halves of a circular rotor 37. Moveable contact arm 32 moves in unison with the rotor 37 upon manual articulation of the circuit breaker operating mechanism (not shown) to drive the movable contacts 30, 36 between CLOSED and OPEN positions. A first contact spring 38 extends between a pair of spring pins 40, 42 within the contact spring slot 48 formed within one side of the rotor 37 and a second contact spring (not shown) extends between pins 40, 42 in a similar manner on the opposite side of rotor 37. An aperture 46 extends through the rotor 37. Aperture 46 allows for a link connection with the circuit breaker operating mechanism to allow manual intervention for opening and closing the circuit breaker contacts in the manner described within the aforementioned U.S. patent application Ser. No. 09/087,038 entitled ROTARY CONTACT ASSEMBLY FOR HIGH AMPERE-RATED CIRCUIT BREAKERS, filed May 29, 1998, which is incorporated by reference.

Figure 2:
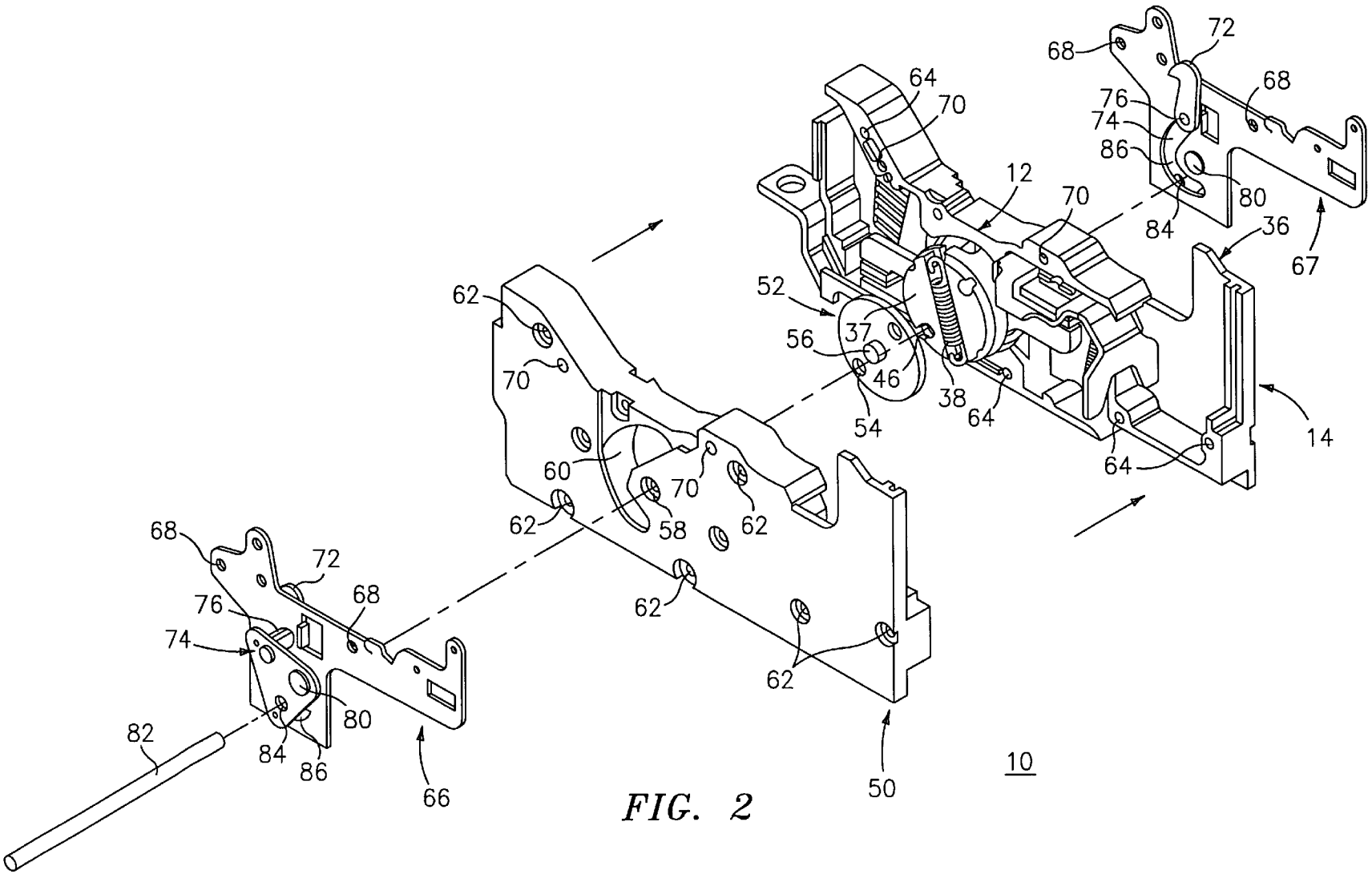
FIG. 2 is a partially exploded perspective view of a cassette assembly with the cassette cover in isometric projection with the rotary contact arrangement of FIG. 1.

Referring to FIG. 2, the circuit breaker cassette assembly 10 is shown prior to attaching a cassette half piece 50 with cassette half piece 14 to form a complete enclosure. The contact spring 38 proximate rotor 37 is protected from contamination by the attachment of a rotor cap 52. A cap aperture 54 in rotor cap 52 aligns with the rotor aperture 46. A radial protrusion 56 extending from the exterior of the cap 52 sits within an aperture 58 formed within the cassette half piece 50 and acts as a bearing surface, which allows the rotor 37 to rotate freely within a slotted aperture 60 formed within the cassette half piece 50. A side (not shown) of rotor 37 proximate cassette half piece 14 is similar to the side of rotor 37 shown in FIG. 2, including a spring 38, rotor cap 52 and aperture 46. The rotor cap 52 proximate cassette half piece 14 also includes a radial protrusion 56 and aperture 54. The radial protrusion 56 proximate cassette half piece 14 extends within an aperture 58 in cassette half piece 14, which also acts as a bearing surface.

With the cassette half piece 50 attached to the cassette half piece 14 by means of apertures 62, 64 and rivets (not shown), a pair of circuit breaker operating mechanism sideframes 66, 67 are next attached to cassette half pieces 50, 14 by pins extending through apertures 68, 70. Operating mechanism lever links (side arms) 72, on opposing sides of the sideframes 14, 50 each connect with a crank lever 74 by a pin 76 extending through a slot 86 formed in sideframes 66, 67. The lever links 72 each connect with the circuit breaker operating mechanism (not shown) in the manner described within the aforementioned U.S. patent application Ser. No. 09/087,038. Crank levers 74 pivotally connect with sideframes 66, 67 by pivots 80 for rotation of crank levers 74 in response to rotation of lever links 72. Operative connection with crank levers 74 and the rotor 37 is provided by means of the extended rotor pin 82 that passes through the apertures 84 in the crank levers 74, slots 86 in sideframes 66, 67, slotted apertures 60 in cassette half pieces 50, 14, the apertures 54 in the rotor caps 52 and the aperture 46 within the rotor 37, as indicated by dashed lines.

Upon activation of lever links 72 by the circuit breaker operating mechanism (not shown), lever links 72 force crank levers 74 to pivot about pivot 80. Extended rotor pin 82 moves in conjunction with lever links 72, thereby rotating rotor 37 and movable contact arm 32 for driving the movable contacts 30, 36 (FIG. 1) between CLOSED and OPEN positions.

Figure 3:
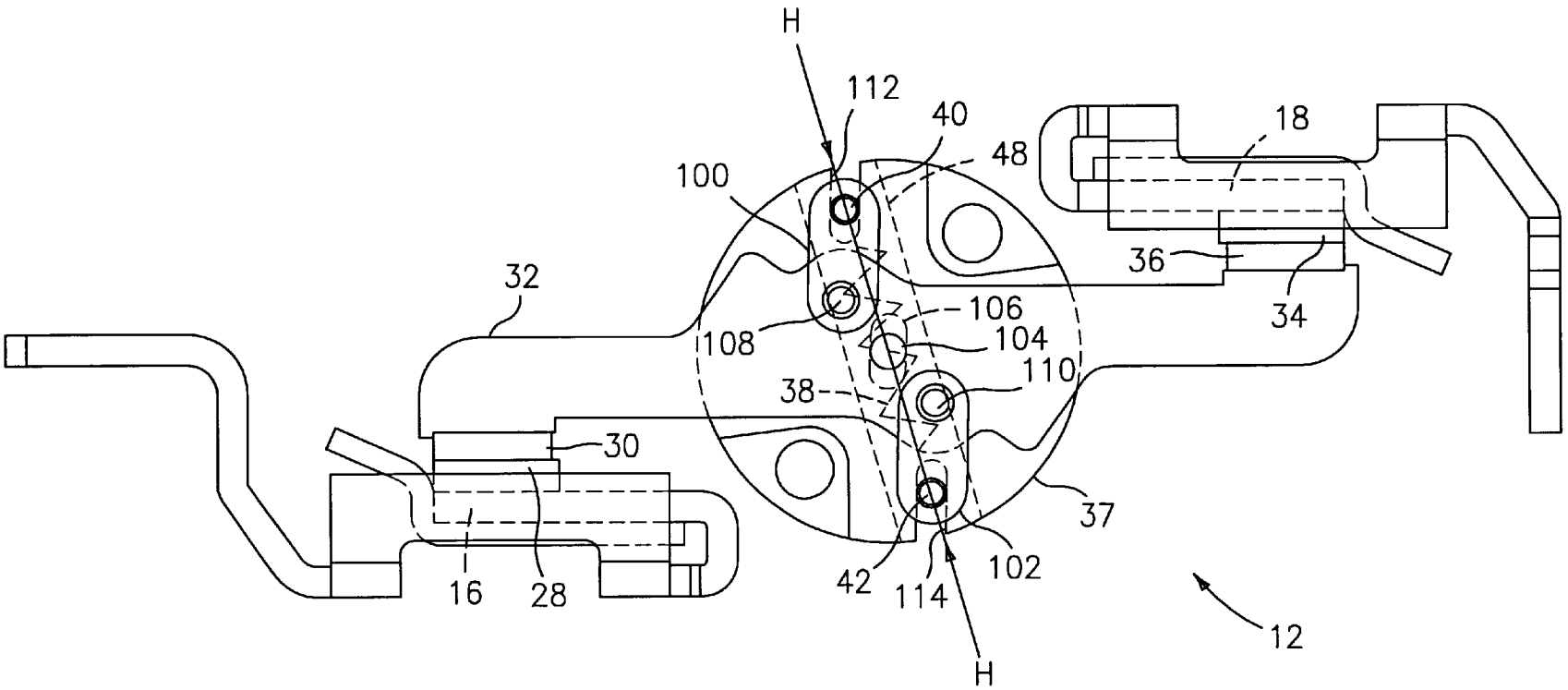
FIG. 3 is an enlarged side view of the rotary contact assembly of FIG. 1 with the circuit breaker contacts in an initial, undamaged condition.

Referring to FIG. 3, rotary contact assembly 12 is shown with contact springs 38 arranged on each side of rotor 37, and movable contact arm 32 having fixed and movable contacts 28, 30, 34, 36 arranged between load and line-side contact straps 18, 16. The contact springs 38 are attached between the movable contact arm 32 and the spring pins 40, 42 by means of a pair of links 100, 102 in the manner described within the aforementioned U.S. patent application Ser. No. 09/087,038. One end of a spring pin 40 attaches to one end of the contact spring 38, via link 100 and is positioned within a pin retainer slot 112 formed in the rotor 37. The other end of the spring pin 40 connects with a similar link and retainer slot (not shown) on the opposite side of the contact arm 32 and the other contact spring 38 on the opposite side of rotor 37. One end of the spring pin 42 attaches to one end of the contact spring 38, via link 102 and is positioned within a pin retainer slot 114 formed in the rotor 37. The other end of the spring pin 42 connects with a similar link and retainer slot (not shown) on the opposite side of the contact arm 32 and the other contact spring 38 on the opposite side of rotor 37. A contact arm pivot pin 104 extends from central portion of rotary contact arm 32 and is captured within the rotor 37 via an elongated clearance slot 106 disposed in rotor 37 to allow contact arm 32 to rotate and translate relative to the rotor 37, in the manner to be described with reference to FIG. 4. A contact arm pin 108 connects the link 100 with the contact arm 32 and a contact arm pin 110 connects the link 102 with the contact arm 32. The contact arm pins 108, 110 connect the other links, although not shown, with the contact arm 32 on the other side of the contact arm 32. Spring pins 40, 42 are positioned in line (co-linear) with the central pivot pin 104 so that the spring force H, exerted between spring pins 40, 42 is directed to intersect the axis of rotation of the movable contact arm 32. The force H is transferred to the movable contact arm 32 via pins 40, 42, links 100, 102 and pins 108, 110. Pins 108 and 110 are offset from the line created by pins 40, 42 and pivot pin 104, allowing the force H to rotate movable contact arm 32. The rotation of movable contact arm 32 urges movable contacts 30, 36 toward fixed contacts 28, 34. Because the force H is centered through the rotational axis of movable contact arm 32, the force of movable contacts 30, 36 onto fixed contacts 28, 34 is substantially equal. The fixed and movable contacts 28, 30, 34, 36 are depicted herein in an undamaged condition, that is, free from any surface erosion.

FIG. 3 shows contact arm 32 in the CLOSED position. Upon an overcurrent condition, fixed contacts 28, 34 and movable contacts 30, 36 are separated by magnetic repulsion that occurs between the fixed contacts 28, 34 and movable contacts 30, 36, as is known the art. The force caused by magnetic repulsion acts against the force created by the contact springs 38, which tends to maintain the fixed and movable contacts 28, 30, 34, 36 in a CLOSED position. If the repulsive force exceeds the force created by springs 38, contact arm 32 rotates in a clockwise direction, while rotor 37 remains stationary. The rotation of contact arm 32 moves pins 108 and 110 around pivot pin 104 and towards the line of force H. The motion of pins 108 and 110 is translated to spring pins 40 and 42 via links 100 and 102, causing pins 40 and 42 to translate within slots 112 and 114 towards the perimeter of rotor 37. The translation of pins 40 and 42 acts against the force of springs 38. If rotary contact arm 32 rotates in a clockwise correction such that pins 108 and 110 move past the line force created by springs 38, springs 38 will act to maintain contact arm 32 in a detented open position, with fixed and movable contacts 28, 30, 34, 36 separated. Once in the detented open position, contact arm is reset to the CLOSED position by rotating the rotor 37 in a counterclockwise direction until pins 108 and 110 are returned to the position shown in FIG. 3.

Figure 4:
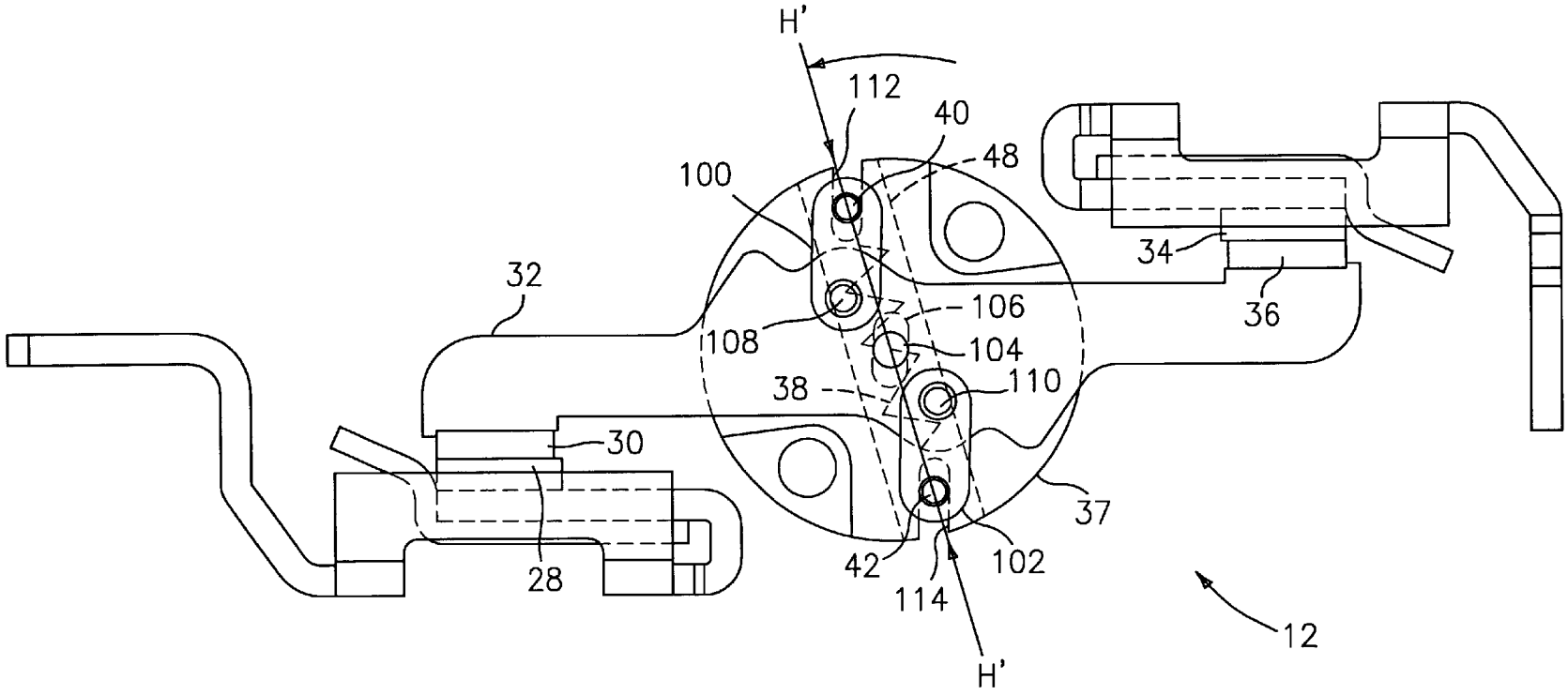
FIG. 4 is an enlarged side view of the rotary contact assembly of FIG. 1 with the circuit breaker contacts in an eroded condition.

Referring to FIG. 4, the rotary contact assembly 12 is shown after extended use and subjected to severe contact erosion between the fixed contact 28, and the movable contact 30, for example, at on end of the movable contact arm 32 within the rotor 37. It is noted that the rotor 37 has rotated in the counter-clockwise direction as indicated, driving the central pivot pin 104 downward within the elongated clearance slot 106 such that the spring force, as now indicated by H', remains directed through the rotational axis of central pivot pin 104, similar to the spring force depicted at H in the undamaged contacts condition shown earlier in FIG. 3. The slight movement of the central pivot pin 104 allows the slight rotation of the spring links 100, 102 attached to the moveable contact arm 32 by means of the spring pins 108, 110, which translate within the retainer links slots 112, 114. Elongated clearance slot 106 and pin retainer slots 112, 114 extend along rotor 37 in the same direction (i.e. substantially parallel to each other) to allow contact arm 32 and spring pins 40 and 42 to translate in the same direction relative to rotor 37. The arrangement of the elongated clearance slot 106 and pin retainer slots 112, 114 allow contact arm 32 and spring pins 40 and 42 to remain in line, which allows the spring force H' to continue to be directed through the axis of rotation of central pivot pin 104. The arrangement of the spring force through the central pivot pin 104 causes the forces between the fixed and moveable contacts 28, 30, 34, 36 to remain constant such as when the fixed and movable contacts 28, 30, 34, 36 were in the undamaged condition depicted earlier in FIG. 3. The constant force between the fixed and movable contacts 28, 30, 34, 36 ensures a uniform transfer of current between the fixed and movable contacts 28, 30, 34, 36, which, in turn, prevents further erosion of the contact surfaces.

A simple arrangement of a single contact spring 38 on each side of a movable contact arm 32 in a lineal relation with the movable contact arm pivot pin 104 has herein been shown to provide an inexpensive means for reducing the effects of contact erosion over long periods of operation.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A circuit breaker rotary contact arrangement comprising:

a rotor defining first and second opposing sides thereon, said rotor including first and second pin retainer slots formed on said first side;

a movable contact arm intermediate said first and second sides, said movable contact arm defining a first movable contact at one end arranged opposite an opposing first fixed contact and a second movable contact at an end opposite said one end arranged proximate a second fixed contact;

a pivot pin arranged on a central portion of said movable contact arm, said pivot pin extending within an aperture formed on a central portion of said rotor for allowing rotation of said movable contact arm with respect to said rotor;

first and second links pivotally secured to a first side of said movable contact arm;

a first spring pin extending from said first link and through said first pin retainer slot;

a second spring pin extending from said second link and through said second pin retainer slot; and a first spring proximate said first side and extending from said first spring pin to said second spring pin, said first spring exerting a first spring force directed to intersect an axis of rotation of said pivot pin, said first spring force for urging said first movable contact toward said first fixed contact and said second movable contact toward said second fixed contact.

2. The rotary contact arrangement of claim 1 wherein said aperture is elongated for allowing said movable contact an to translate relative to said rotor.

3. The rotary contact arrangement of claim 2 wherein said aperture and said first and second pin retainer slots are arranged to allow said movable contact arm and said first and second spring pins to translate in a single direction relative to said rotor.

4. The rotary contact arrangement of claim 1 further including:

third and fourth links pivotally secured to a second side of said movable contact arm;

said rotor further including third and fourth pin retainer slots formed on said second side;

said first spring pin further extending through said third pin retainer slot;

said second spring pin further extending through said fourth pin retainer slot; and a second spring proximate said second side and extending from said first spring pin to said second spring pin, said second spring exerting a second spring force directed to intersect an axis of rotation of said pivot pin, said second spring force for urging said first movable contact toward said first fixed contact and said second movable contact toward said second fixed contact.

5. The rotary contact arrangement of claim 4 wherein said aperture and said first, second, third, and fourth pin retainer slots are arranged to allow said movable contact arm and said first and second spring pins to translate in a single direction relative to said rotor.

6. The rotary contact arrangement of claim 1 including first and second electrically-insulative cassette half pieces, said rotor and said movable contact an being retained intermediate said first and second cassette half pieces.

7. The rotary contact arrangement of claim 6 including a rotor cover arranged over said rotor, said rotor cover defining a radial protrusion extending from an outer surface thereon, said radial protrusion extending within an aperture formed within said first electrically-insulative cassette half piece.

8. A circuit breaker assembly comprising:

a line-side contact strap arranged for connection with an electric circuit, said line-side contact strap including a first fixed contact connected to said line-side contact strap;

a load-side contact strap arranged for connecting with associated electrical equipment, said load-side contact strap including a second fixed contact connected to said load-side contact strap;

first and second arc chutes, said first arc chute proximate said line-side contact strap and said second arc chute proximate said load-side contact strap for quenching arcs occurring upon overcurrent transfer between said line and load-side contact straps; and a rotary contact assembly disposed between said line and load-side contact straps and said first and second arc chutes, said rotary contact assembly including:

a rotor defining first and second opposing sides thereon, said rotor including first and second pin retainer slots formed on said first side, a movable contact arm intermediate said first and second sides, said movable contact arm defining a first movable contact at one end arranged opposite said first fixed contact and a second movable contact at an end opposite said one end arranged proximate said second fixed contact, a pivot pin arranged on a central portion of said movable contact arm, said pivot pin extending within an aperture formed on a central portion of said rotor for allowing rotation of said movable contact arm with respect to said rotor, first and second links pivotally secured to a first side of said movable contact arm, a first spring pin extending from said first link and through said first pin retainer slot, a second spring pin extending from said second link and through said second pin retainer slot; and a first spring proximate said first side and extending from said first spring pin to said second spring pin, said first spring exerting a first spring force directed to intersect an axis of rotation of said pivot pin, said first spring force for urging said first movable contact toward said first fixed contact and said second movable contact toward said second fixed contact.

9. The circuit breaker assembly of claim 8 wherein said aperture is elongated for allowing said movable contact arm to translate relative to said rotor.

10. The circuit breaker assembly of claim 8 wherein said aperture and said first and second pin retainer slots are arranged to allow said movable contact arm and said first and second spring pins to translate in a single direction relative to said rotor.

11. The circuit breaker assembly of claim 9 wherein said rotary contact assembly further includes:

third and fourth links pivotally secured to a second side of said movable contact arm;

said rotor further including third and fourth pin retainer slots formed on said second side;

said first spring pin further extending through said third pin retainer slot;

said second spring pin further extending through said fourth pin retainer slot; and a second spring proximate said second side and extending from said first spring pin to said second spring pin, said second spring exerting a second spring force directed to intersect an axis of rotation of said pivot pin, said second spring force for urging said first movable contact toward said first fixed contact and said second movable contact toward said second fixed contact.

12. The circuit breaker assembly of claim 11 wherein said aperture and said first, second, third, and fourth pin retainer slots are arranged to allow said movable contact arm and said first and second spring pins to translate in a single direction relative to said rotor.

13. The circuit breaker assembly of claim 8 including first and second electrically-insulative cassette half pieces, said rotor and said movable contact arm being retained intermediate said first and second cassette half pieces.

14. The circuit breaker assembly of claim 13 including a rotor cover arranged over said rotor, said rotor cover defining a radial protrusion extending from an outer surface thereon, said radial protrusion extending within an aperture formed within said first electrically-insulative cassette half piece.

* * * * *